United States Patent [19]

Straub

[11] Patent Number: 4,978,309

[45] Date of Patent: Dec. 18, 1990

[54] IGNITER CABLE CONNECTOR

[75] Inventor: Stephen W. Straub, Toledo, Ohio

[73] Assignee: Champion Spark Plug Company, Toledo, Ohio

[21] Appl. No.: 327,476

[22] Filed: Mar. 17, 1989

[51] Int. Cl.[5] ..... H01R 13/52

[52] U.S. Cl. ..... 439/126

[58] Field of Search ..... 439/125–128

[56] References Cited

U.S. PATENT DOCUMENTS

| | | | |
|---|---|---|---|
| 2,129,961 | 1/1938 | Rabezzana | 123/169 |
| 2,238,397 | 1/1941 | Rabezzana | 123/169 |
| 2,351,066 | 6/1944 | Race | 439/126 X |
| 2,399,390 | 9/1946 | Robertson | 174/35 |
| 3,076,113 | 12/1963 | Candelise | 313/135 |
| 3,334,326 | 4/1967 | Besore et al. | 339/26 |
| 4,266,841 | 2/1981 | Sherwood | 339/89 C |

*Primary Examiner*—Eugene F. Desmond

*Attorney, Agent, or Firm*—MacMillan, Sobanski & Todd

[57] ABSTRACT

An improved high voltage igniter connector for aircraft applications. An insulator projecting from the cable connector extends into a tubular insulator in the igniter. An electrical contact at the free end of the connector insulator is urged into contact with a center electrode terminal in the igniter. A resilient annular first seal is formed between the connector and an end of the igniter insulator. A resilient annular second seal is located between the connector insulator and the interior wall of the igniter insulator near the free end of the connector insulator to increase resistance to flashover at the connector.

2 Claims, 4 Drawing Sheets

IGNITER CABLE CONNECTOR

TECHNICAL FIELD

This invention relates to high voltage electrical connectors for engine ignition systems and more particularly to an improved high voltage electrical connector for connecting a shielded ignition cable to an igniter used in aircraft engine applications.

BACKGROUND ART

Connectors for high voltage cables used in aircraft ignition systems are subject to extreme operating conditions. The reduced atmospheric pressure in which the connectors are used increases the tendency for flashover or short-circuiting to occur between the igniter and the connector.

In one type of igniter commonly used for aviation engines, a center electrode terminal is recessed within the bore of a tubular ceramic insulator. An outer metallic igniter shell or a tubular metal sleeve attached to the shell surrounds and shields the outside of the tubular insulator. The free end of the sleeve adjacent to an open end of the insulator has an external thread for retaining a coupling nut on a cable connector. When the cable connector is attached to the igniter, an insulator on the connector projects into the tubular igniter insulator bore and a high voltage contact mounted at the end of the connector insulator is urged by springs inside the connector against the center electrode terminal. The cable connector functions both to electrically connect the high voltage cable to the igniter and to prevent flashover or arcing from the junction between the connector contact and the center electrode terminal to the grounded outer shell or sleeve on the igniter.

In the prior art, it is known to provide a resilient rubber grommet or seal between the cable connector and the end of the igniter insulator. Often a spring is arranged to urge the grommet against the insulator end to maintain a tight seal. The function of the grommet is to prevent dirt and moisture from entering an annular space between the insulator on the end of the connector and the tubular igniter insulator. However, sufficient dirt and/or moisture sometimes enters the space between the igniter and connector insulators to cause flashover.

DISCLOSURE OF INVENTION

According to the invention, problems with flashover in the region between the igniter insulator and the connector insulator are reduced by placing an additional resilient seal between the insulators. The additional seal is located adjacent the electrical connection between the cable and the igniter's center electrode. According to a first embodiment of the invention, the additional seal is annular shaped and is placed in the lower end of the igniter insulator bore to surround the center electrode terminal. When the cable connector is attached to the igniter, the end of the connector insulator presses against the grommet to form an annular seal surrounding the electrical connection between the cable connector and the center electrode. According to a second embodiment of the invention, the seal is in the form of a resilient 0-ring located between the connector insulator and the interior wall of the tubular igniter insulator. The 0-ring seal is located towards the lower end of the connector insulator. According to a third embodiment of the invention, a step is formed in the connector insulator facing toward the projecting insulator end. A complementary internal step is formed in the igniter insulator bore above the center electrode terminal. A resilient annular seal is positioned on the igniter insulator step for forming a seal between the igniter insulator step and the connector insulator step at a location spaced close to the end of the connector insulator.

With each of the embodiments of the invention, a conventional first seal is located between the end of the igniter insulator and the connector and a second seal is located between the igniter insulator and the connector insulator at a location near the electrical connection between the connector contact and the center electrode terminal. The igniter cable connector of the invention provides improved flashover protection over prior art cable connectors.

BEST MODE FOR CARRYING OUT THE INVENTION

Figure 1:
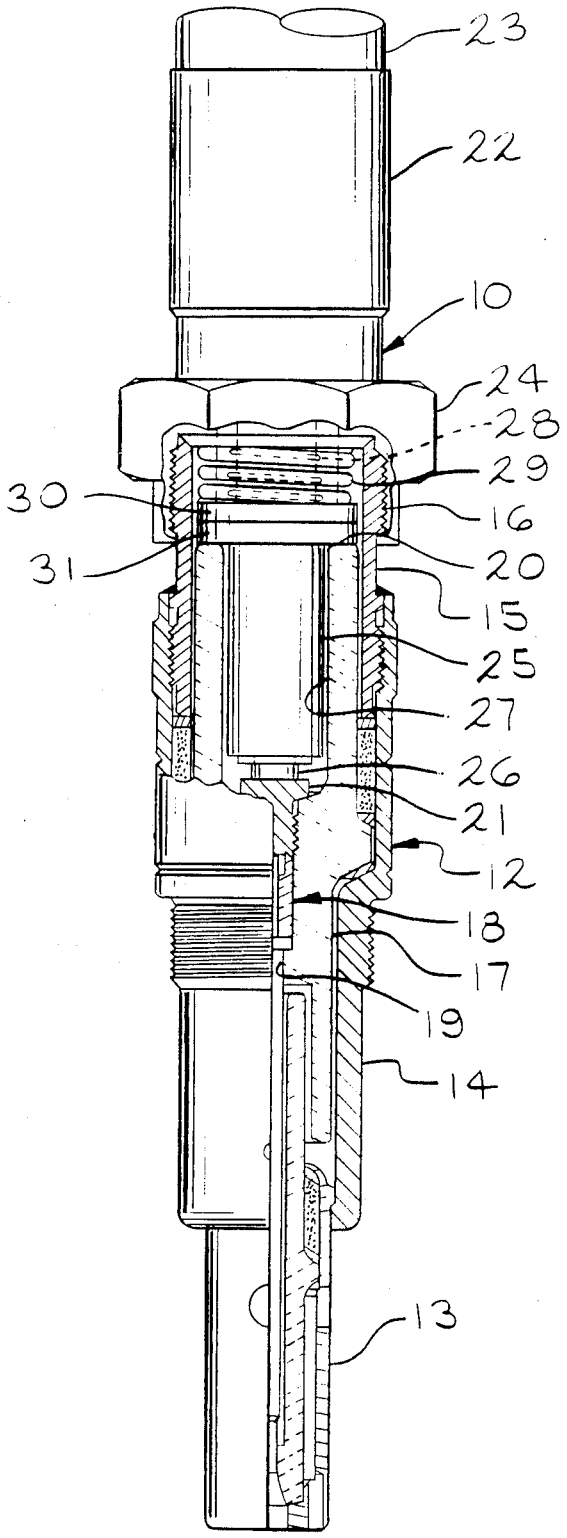
FIG. 1 (PRIOR ART)
FIG. 1 is a vertical view in partial section showing a high voltage ignition cable connector attached to an igniter according to the prior art.

Turning to FIG. 1 of the drawings, a prior art high voltage ignition cable connector 10 is shown attached to a conventional aviation engine igniter 11. The igniter 11 has a tubular shell 12 which may be formed from one or several sections. In the illustrated igniter 11, the shell 12 has a lower section 13, an intermediate section 14 and an upper section 15. The upper section 15 is in the form of a tubular sleeve and has an externally threaded end 15. A tubular insulator 17 is mounted in the shell 12 and a center electrode assembly 18 is mounted in a stepped axial bore 19 through the insulator 17. The insulator 17 has a free end 20 adjacent the threaded shell end 15. The center electrode 18 terminates at a terminal 21 recessed in the insulator bore 19 from the free end 20.

The connector 10 has a ferrule 22 which is clamped onto the exterior of a shielded high voltage ignition cable 23. A coupling nut 24 retained on the ferrule 22 engages the threaded igniter shell end 16 to attach the connector 10 to the igniter 11. The connector 10 has a tubular insulator 25 which projects through the coupling nut 24 and terminates at a contact 26. The contact 26 is electrically connected to a high voltage conductor (not shown) inside of the ignition cable 23. The insulator 25 insulates the contact 26 from electrically grounded components including the connector ferrule 22, the cable shielding and the coupling nut 24. The connector insulator 25 is sized to slide into an end section 27 of the igniter insulator bore 19 above the terminal 21.

When the connector 10 is attached to the igniter 11, the connector contact 26 contacts the igniter terminal 21. A first or inner spring 28 in the connector 10 urges the insulator 25 and the contact 26 into the igniter bore end section 27 to bias the contact 26 against the terminal 21 for maintaining an electrical connection at all times. The connector also includes a second or outer spring 29, a tubular sleeve 30 and a resilient annular seal 31. When the connector 10 is attached to the igniter 11, the spring 29 presses in an axial direction on the tubular sleeve 30 to in turn urge the seal 31 toward the igniter insulator end 20. As a consequence of the force of the spring 29 and the resiliency of the seal 31, a continuous annular seal is formed between the tubular sleeve 30 and the igniter insulator end 20. The purpose of the seal is to keep dirt and moisture from the annular region between the igniter insulator bore end section 27 and the connector insulator 25. However, under certain operating conditions, sufficient contaminants may enter this region to cause arcing from the terminal 21 and/or the contact 26 and the upper shell section 15.

Figure 2:
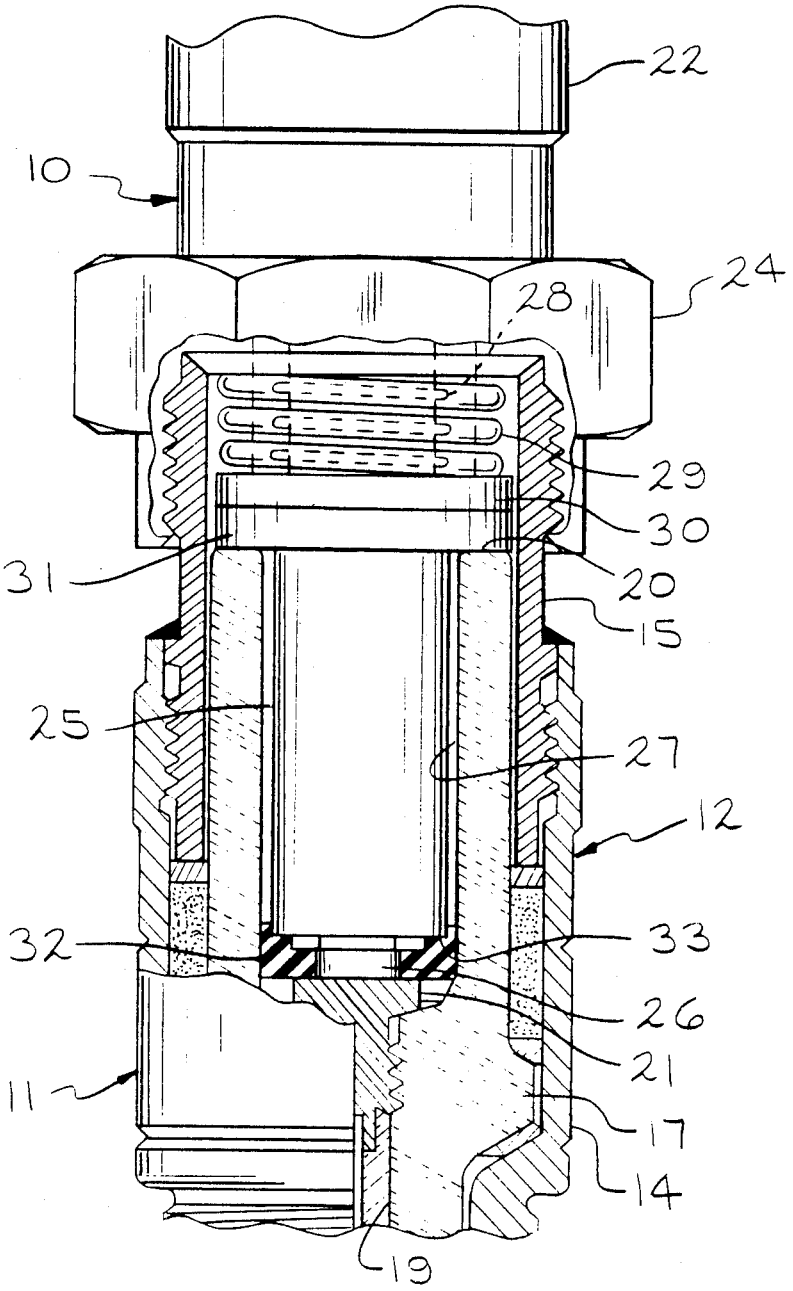
FIG. 2 is a fragmentary vertical view in partial section showing a high voltage ignition cable connector attached to an igniter according to a first embodiment of the invention.
Figure 3:
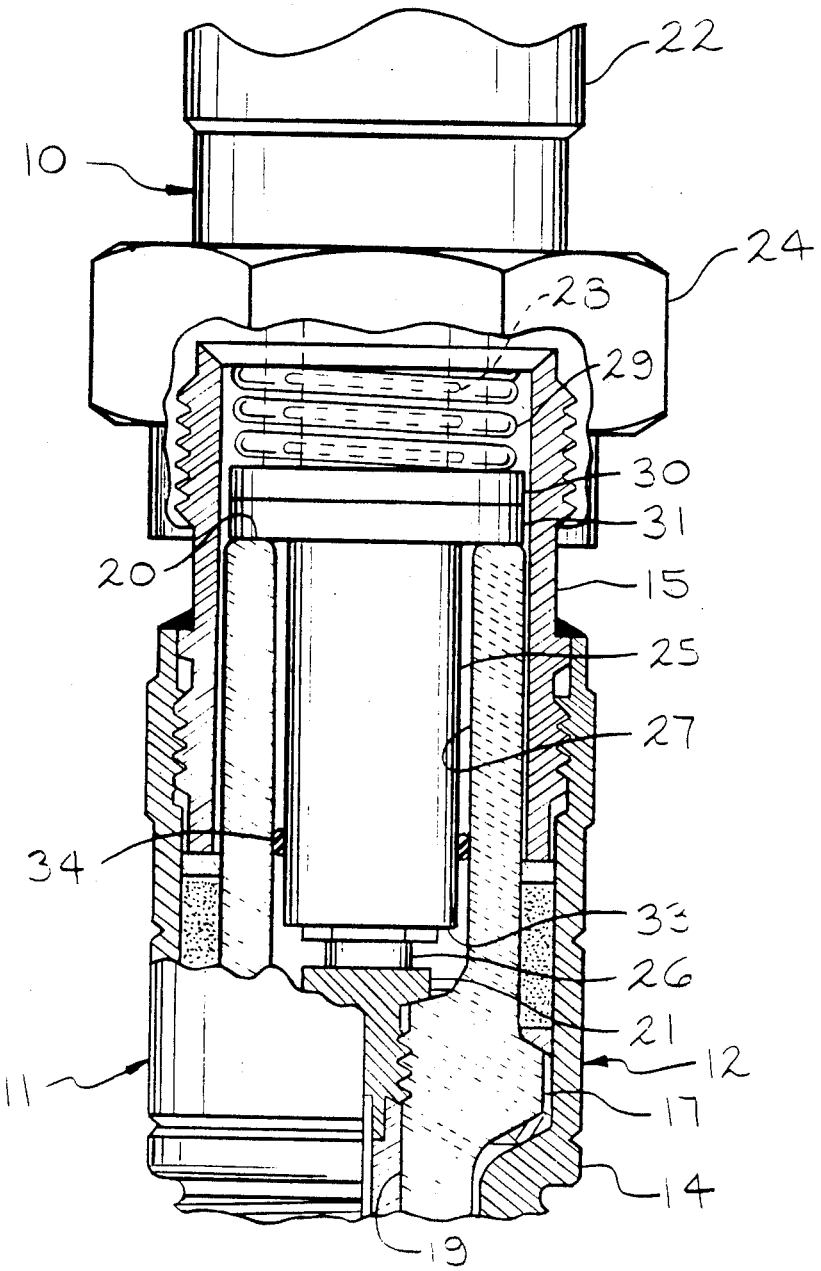
FIG. 3 is a fragmentary vertical view in partial section showing a high voltage ignition cable connector attached to an igniter according to a second embodiment of the invention.
Figure 4:
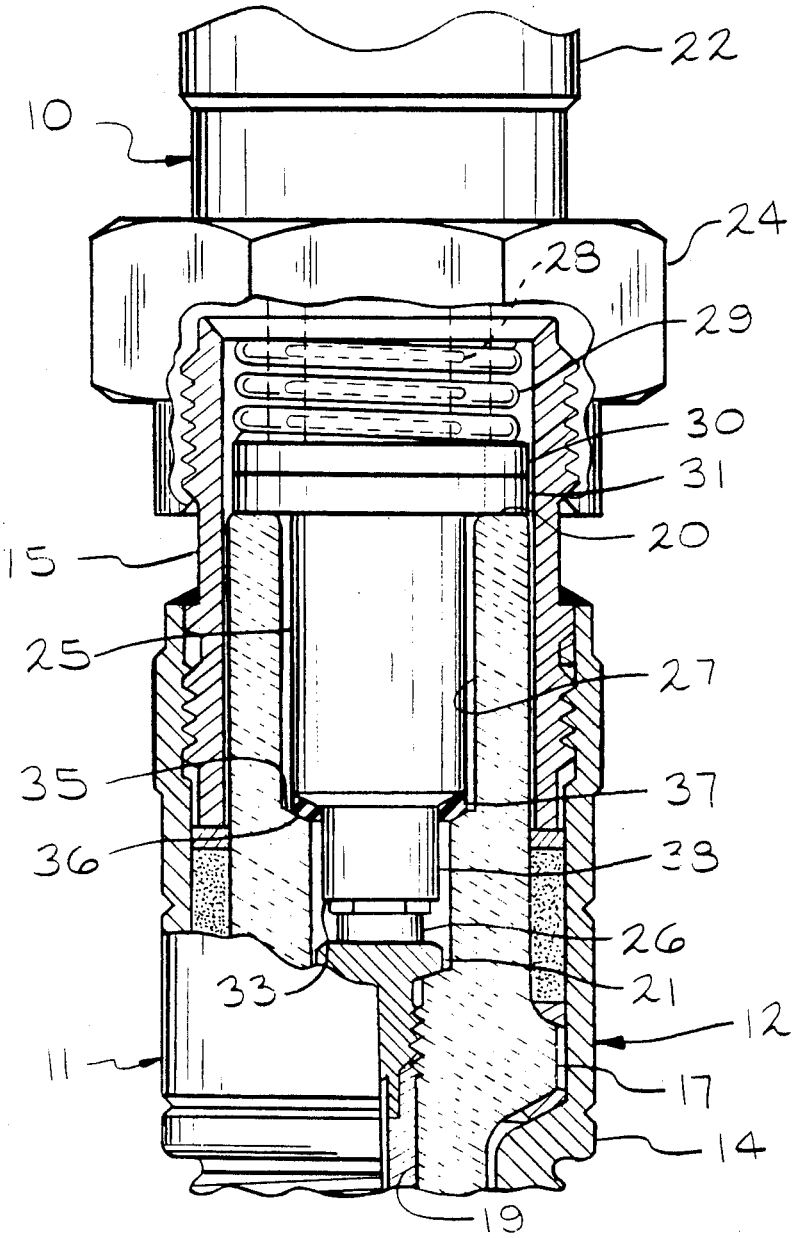
FIG. 4 is a fragmentary vertical view in partial section showing a high voltage ignition cable connector attached to an igniter according to a third embodiment of the invention.

According to the invention, a second seal is formed between the igniter 11 and the connector insulator 25. Preferably, the second seal is formed near or adjacent the electrical connection between the connector contact 26 and the igniter terminal 21. Three different embodiments of the invention are illustrated in FIGS. 2–4. Since the connector 10 and the igniter 11 may be essentially the same as the prior art connector 10 and igniter 11, components in FIGS. 2–4 which correspond to components in FIG. 1 will bear the same references.

In a first embodiment of the invention illustrated in FIG. 2, a resilient annular seal 32 is positioned on an end 33 of the connector insulator 25 adjacent to and surrounding the contact 26. The seal 32 is sized to resiliently engage the contact 26, the insulator end 33 and the wall of the igniter insulator bore end section 27. The seal 33 has sufficient resilience to permit insertion of the seal 33 and the connector insulator 25 into the igniter insulator bore end 27 without interfering with attachment of the connector 10 to the igniter 11 and without interfering with the electrical connection between the connector contact 26 and the igniter terminal 21.

In a second embodiment of the invention illustrated in FIG. 3, a resilient O-ring seal 34 is compressed between the connector insulator 25 and the wall of the igniter insulator bore end section 27. Preferably, the seal 34 is located just above the insulator end 33 to be adjacent the contact 26. The thickness of the O-ring seal 34 is greater than the maximum spacing between the connector insulator 25 and the igniter insulator end section 27 to maintain a continuous annular seal around the insulator 25. If desired, a groove (not shown) may be formed in the connector insulator 25 to position the seal 34 when the connector 10 and the igniter 11 are connected and disconnected.

In a third embodiment of the invention illustrated in FIG. 4, the end section 27 of the igniter insulator is formed with an internal annular step 35 which faces toward the insulator end 20. A corresponding complementary annular step 36 is formed on the connector insulator 25. A resilient annular seal 37 is positioned on the end 38 of the connector insulator 25 below the step 36. When the connector 10 is attached to the igniter 11, the seal 37 is compressed between the insulator steps 35 and 36 to form a continuous annular seal extending around the connector insulator 25 adjacent the end 33 and the contact 26.

In each of the above described embodiments of the invention, a first seal is formed between the connector 10 and the end 20 of the igniter insulator 17 and a second seal is formed between the connector insulator 25 and the wall of the igniter insulator bore 19. The second seal is spaced from the first seal and preferably is adjacent or close to the connector contact 26. It will be appreciated that further variations of the construction of the second seal can be made without departing from the scope of the following claims.

I claim:

1. A connection between a high voltage ignition cable and an igniter, said igniter having an outer shell surrounding a tubular insulator about the axis of said insulator, said shell and insulator having adjacent open ends with exterior threads on said shell end, said igniter having a center electrode terminal recessed in said tubular insulator, and a connector having a coupling nut threaded to engage said threaded shell end, a projecting cylindrical insulator having a free end and a high voltage contact at said free end, said connector insulator projecting into said igniter insulator with said contact electrically contacting said center electrode terminal when said connector is attached to said igniter, and a first annular seal on said connector engaging said igniter insulator end when said connector is attached to said igniter, the improvement comprising a second seal between said igniter insulator and said connector insulator spaced from said first seal and extending about the axis of said insulator, and wherein said second seal is a resilient O-ring seal located between said connector insulator and the interior wall of said tubular igniter insulator.

2. A connection between a high voltage ignition cable and a igniter, said igniter having an outer shell surrounding a tubular insulator about the axis of said insulator, said shell and insulator having adjacent open ends with exterior threads on said shell end, said igniter having a center electrode terminal recessed in said tubular insulator, and a connector having a coupling nut threaded to engage said threaded shell end, a projecting cylindrical insulator having a free end and a high voltage contact at said free end, said connector insulator projecting into said igniter insulator with said contact electrically contacting said center electrode terminal when said connector is attached to said igniter, and a first annular seal on said connector engaging said igniter insulator end when said connector is attached to said igniter, the improvement comprising a second seal between said igniter insulator and said connector insulator spaced from said first seal and extending about the axis of said insulator, and wherein the exterior surface of said connector insulator and the interior wall of said tubular igniter insulator have complementary steps which are spaced apart by a predetermined spacing when said connector is attached to said igniter, and wherein said second seal comprises a resilient annular seal located between said complementary insulator steps.

* * * * *